United States Patent [19]

Jadouin

[11] 4,214,716

[45] Jul. 29, 1980

[54] PULVERIZER

[76] Inventor: Michel A. Jadouin, 4/31 William St., Rose Bay, New South Wales, Australia, 2029

[21] Appl. No.: 946,636

[22] Filed: Sep. 28, 1978

Related U.S. Application Data

[63] Continuation-in-part of Ser. No. 845,883, Oct. 27, 1977, abandoned.

[30] Foreign Application Priority Data

Nov. 11, 1976 [AU] Australia ..... PC7948

[51] Int. Cl.[2] ..... B02C 13/282

[52] U.S. Cl. ..... 241/186 R; 241/188 R; 241/193; 241/194; 241/285 R

[58] Field of Search ..... 241/186 R, 188 R, 190, 241/191, 193, 194, 285 R

[56] References Cited

U.S. PATENT DOCUMENTS

| | | | |
|---|---|---|---|
| 1,212,419 | 1/1917 | Sturtevant | 241/188 R X |
| 1,638,381 | 8/1927 | Whitham | 241/188 R X |
| 2,082,419 | 6/1937 | Rietz | 241/188 R X |
| 2,700,511 | 1/1955 | Denovan et al. | 241/194 X |
| 3,144,213 | 8/1964 | Hedlund | 241/285 R X |
| 3,229,921 | 1/1966 | Hess | 241/190 |
| 3,326,475 | 6/1967 | Lykken et al. | 241/186 R X |
| 3,577,998 | 5/1971 | Pinkham | 241/188 R X |
| 3,851,829 | 12/1974 | Dopper et al. | 241/188 R X |
| 3,993,256 | 11/1976 | Brewer | 241/188 R X |

*Primary Examiner*—Howard N. Goldberg
*Attorney, Agent, or Firm*—Davis, Hoxie, Faithfull & Hapgood

[57] ABSTRACT

This invention relates to pulverizers of the kind comprising a barrel having an inlet for material to be pulverized, an outlet, an upright rotor rotatable within the barrel and a plurality of hammers mounted on the rotor. Apparatus according to the invention is provided with a double shell barrel having an inner shell spaced radially from the outer shell by tubular braces which also serve to mount striker blades. Preferably the striker blades are longitudinally adjustable and preferably the hammers are swing mounted.

9 Claims, 14 Drawing Figures

PULVERIZER

RELATED APPLICATION

This is a continuation-in-part application of Ser. No. 845,883 filed Oct. 27, 1977, now abandoned.

BACKGROUND OF THE INVENTION

This invention relates to pulverisers of the kind comprising a barrel having an open top for infeed of material to be pulverised and a bottom outlet for departure of pulverised material, an upright rotor rotatable within the barrel, and a plurality of hammers mounted on the rotor.

Within known pulverisers of this kind in which the wall of the barrel is relatively free of obstruction, the pulverising action is unsatisfactory for non-frangible, particularly light, tough materials, such as plastics and paper, since they remain practically intact after the pulverising process.

Such pulverisers also suffer from the disability effectively to deal with feed materials containing rags, cords and such like which tend merely to wind about the rotor and frequently cause jamming. Moreover, in use, the "granularity", that is to say, the size of the particulate material produced by such pulverisers, steadily increases as a result of the increase in spacing between the hammer tips and the barrel, due to hammer wear.

Pulverisers are known in which stationary baffles, striker plates or striker bars are fixed to the wall of the barrel. In such cases, the stationary striker bars are in the nature of cantilevers which, in use, are constantly subjected to shock or impact loading, and, as with any cantilever, the maximum bending moment occurs at the point of support. It follows that the cantilever supports have to be robust to withstand the loadings in question. This requires the barrel to be of massive construction and consequently such pulverisers generally have a very much higher weight to power ratio than pulverisers which do not have stationary blades. The total weight of such pulverisers, due largely to the massive barrel construction, has proved to be a serious disability for many applications. For example, as a result it has been very difficult, if not impossible, to mount such pulverisers on a vehicle such as a garbage collection vehicle, notwithstanding the fact that it is known to be desirable for material such as garbage to be pulverised before being compacted in the vehicles holding receptacle in order to increase the total quantity of material that the vehicle may accept.

A further disadvantage of known pulverisers of the type under discussion springs from the fact that the optimum spacing of the rotatable hammers from the barrel wall or from stationary strikers fixed to the barrel wall, varies according to the feed material. Thus, for optimum efficiency in pulverising aluminium cans, it is desirable that the clearance space between rotatable hammers and the barrel wall or stationary strikers is less than if garbage or glass are to be pulverised, while for optimum efficiency in pulverising steel cans the clearance is intermediate between the optimum for aluminium and the optimum for glass. Known pulverisers of this type are therefore generally inefficient for handling a wide range of different infeed material types.

SUMMARY OF THE INVENTION

The present invention overcomes these disabilities by providing a plurality of stationary striker blades projecting inwardly of the barrel. The stationary blades are preferably staggered in relation to the hammers and there is a substantial clearance between stationary blades and hammers.

The barrel is a double shell barrel having an inner shell spaced radially from an outer shell and a plurality of tubular braces extending radially from one shell to the other. The stationary blades are preferably bar-like elements mounted by being at least partially housed within the tubular braces and are thereby braced against lateral force. Thus, the barrel construction, by virtue of the thickness between the inner and outer shell permits the necessary strength in the cantilever support for the stationary blades to be readily achieved and yet by virtue of the relative thinness of the shells does not add to, but rather reduces, the weight of material comprising the barrel. This reduction in weight is in turn sufficient to enable the pulveriser to be mounted on a conventional vehicle such as a garbage collection vehicle.

In preferred embodiments the extent to which the stationary blades project into the barrel may be adjusted. This enables compensation for hammer wear and thus maintenance of substantially constant granularity for a given feed stock. Adjustability of the stationary blades also permits a more nearly optimum spacing between the rotary hammers and the stationary blades to be set for any of a variety of feed stock types. Adjustment of the stationary blades may be simply achieved by sliding the stationary blades longitudinally in the tubular braces and simple means may be provided externally of the barrel to lock the blades against movement in their longitudinal direction.

If desired, the longitudinal position adjustment of the blades may be infinitely variable over a pre-determined range by using a nut and bolt type fastening for the blade, but for preference each blade has a number of pin clearance holes through it and adjustment in discrete steps is provided simply by withdrawing a locking pin (or like element) moving the blade inwardly or outwardly as needed, and re-inserting the locking pin in a different clearance hole.

A further advantage flowing from the double-shell construction of pulverisers according to the invention is that the space between the two shells may be packed with sound absorbent material to reduce the noise that the pulveriser makes when in operation without greatly increasing its weight. On the other hand, if the pulveriser is to be used in a large and fixed installation, the space between the shells may be packed with a heavy ballasting material such as water or sand to increase stability and once again (but to a lesser extent) to reduce the noise of operation.

In more highly preferred embodiments, the longitudinal insertion or withdrawal of stationary blades is achieved hydraulically.

BRIEF DESCRIPTION OF THE DRAWINGS

By way of example, various embodiments of the above described invention are described hereinafter with reference to the accompanying drawings.

The said first embodiment pulveriser comprises a barrel having an inner shell 8, an outer shell 9, a floor 10 and cover 11.

Figure 1:
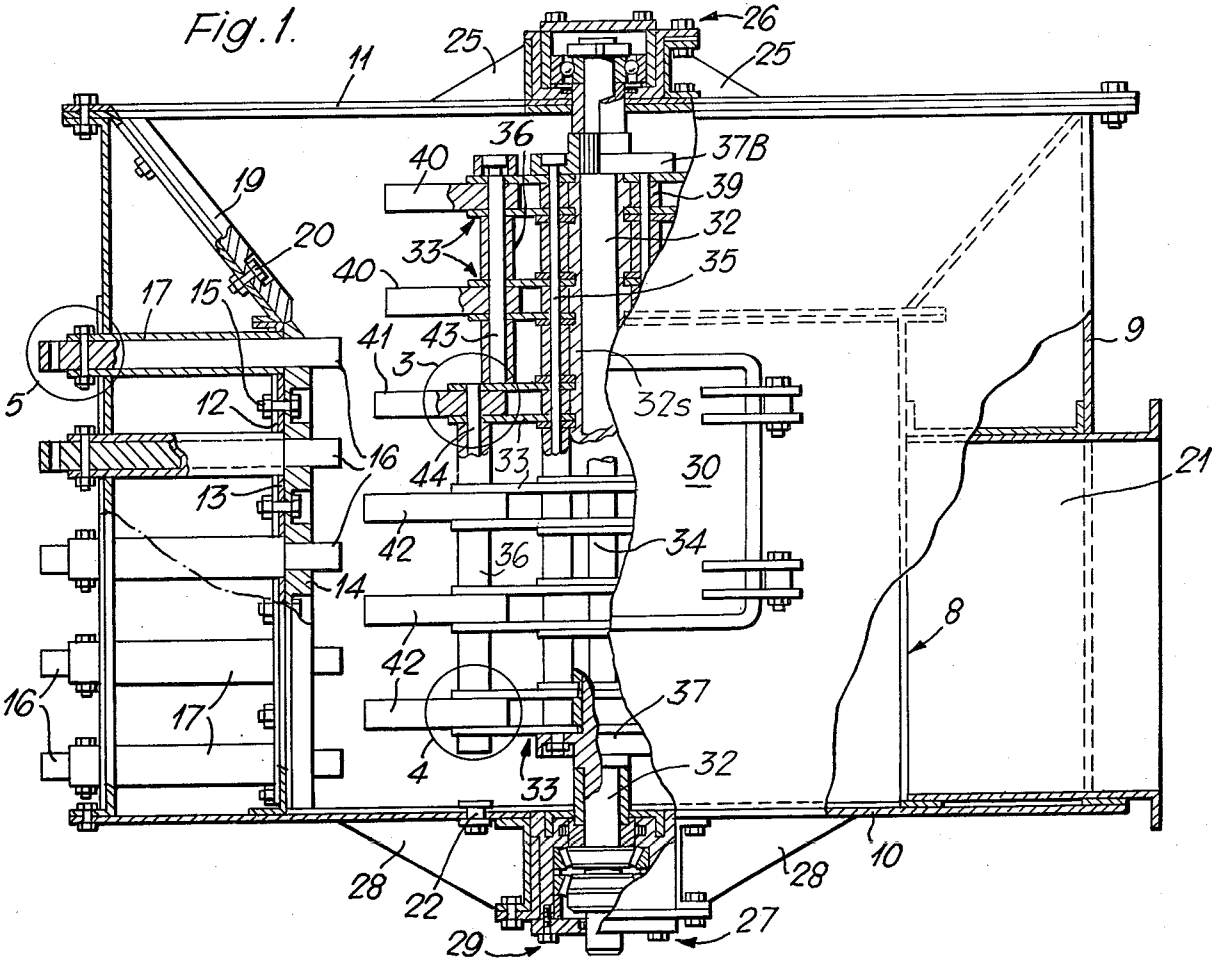
FIG. 1 is a side elevation of a pulveriser being a first embodiment of the invention, with parts of its external shell and some of its internal components partly cut away to reveal further internal details.

The inner shell is of laminated laminar construction as can best be seen in FIG. 1 comprising an outer skin 12, an inner wear resistant liner 13, and, to reduce the noise of operation, a thin elastomeric layer (not shown) sandwiched between the skin 12 and liner 13.

The liner 13 is comprised of four segments secured to the skin 12 by four broadly T-sectioned breaker bars 14. The breaker bars 14 are secured to the inner shell by throughbolts 15 and serve two functions, namely to hold the liner 13 in place and to serve as obstructions against which the material to be pulverised strikes and is thereby broken to smaller pieces.

Five stationary blades 16 extend through each breaker bar 14 to project radially inwardly of the inner shell 8 of the barrel of the pulveriser. The stationary blades 16 are encased in rectangular sectioned bracing tubes 17 welded to the outer shell 9 and to the outer skin 12 of the inner shell 8.

Figure 5:
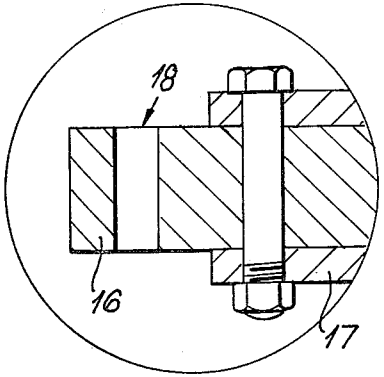
FIGS. 4 and 5 are views similar to FIG. 3 of the details within the corresponding circles 4 and 5 of FIG. 1.

The tubes 17 project radially outwardly beyond the outer shell 9 and are furnished with bolt clearance holes externally of that shell whereby the longitudinal position of the blades 16 may be adjusted by selecting any one of a plurality of bolt clearance holes 18 (see FIG. 5) therethrough.

In the illustrated embodiment each of the blades 16 has only two bolt clearance holes extending through it but it will be appreciated that the number may be increased considerably beyond two if space outside of the outer shell 9 permits so that the extent of positional adjustment and the number of positions in which the blades may be held is correspondingly increased.

The upper portion of the inner shell 8 diverges upwardly and outwardly to meet the rim of the outer shell 9.

The diverging portion of the shell 8 is of similar laminated construction to the cylindrical lower portion and thus comprises an outer skin, an inner liner and an elastomeric sheet sandwiched between those parts, the whole assembly being held together by clamping bars 19 and clamping bolts 20.

Both of the inner and outer shells have a bottom outlet or exit orifice formed in them and a radially outwardly diverging trunk 21 is provided through which pulverised material exits from the pulveriser.

The centre portion of the floor 10, that is to say, the portion within the inner shell 8 is similarly of a laminated construction comprising an outer skin, an inner liner in the form of four segments secured to the outer skin by over-lapping bolts 22 at the junction of each segment and an elastomeric layer between them.

Figure 2:
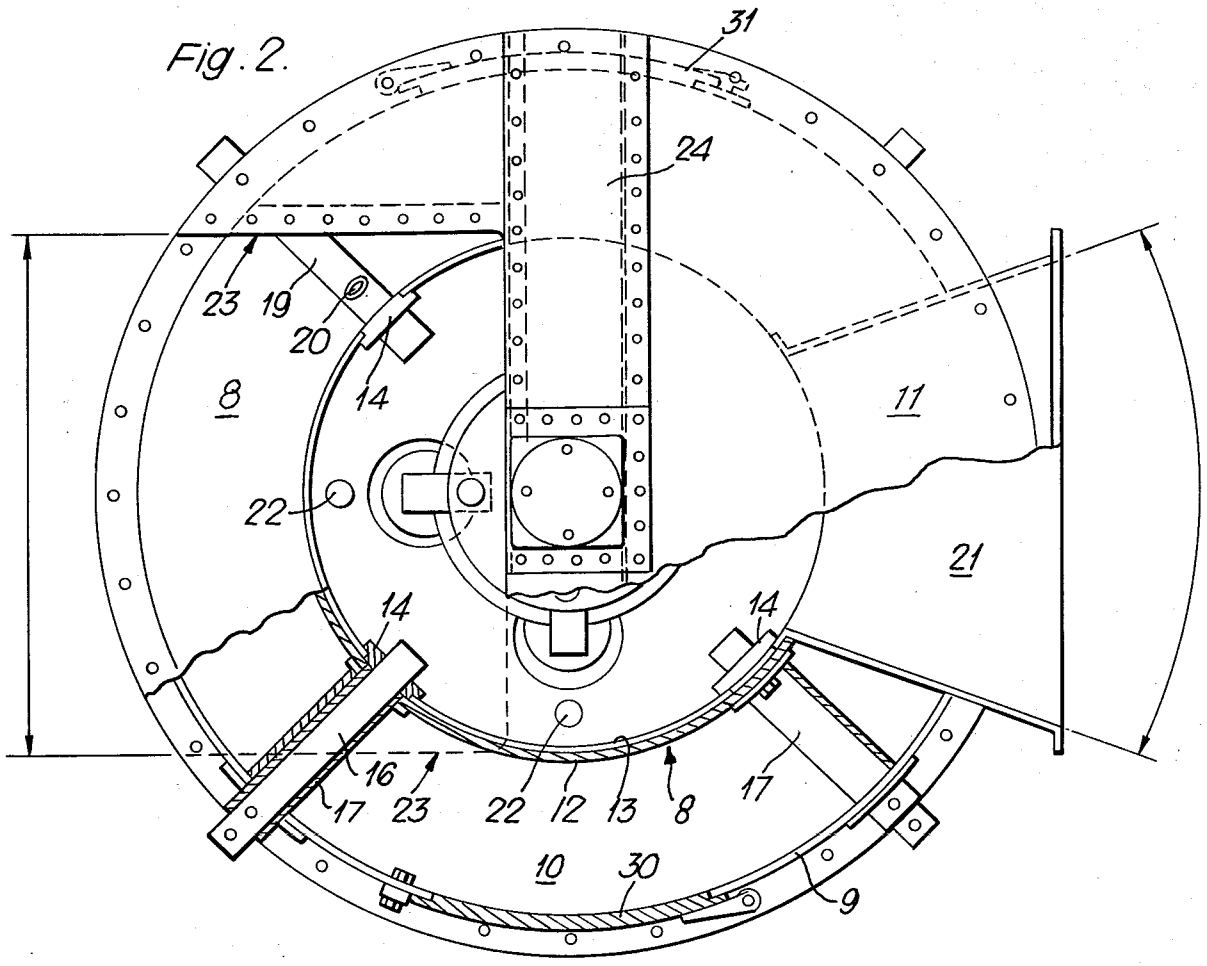
FIG. 2 is a plan view of the pulveriser of FIG. 1 with its top cover partly cut away to reveal internal details.
Figure 6:
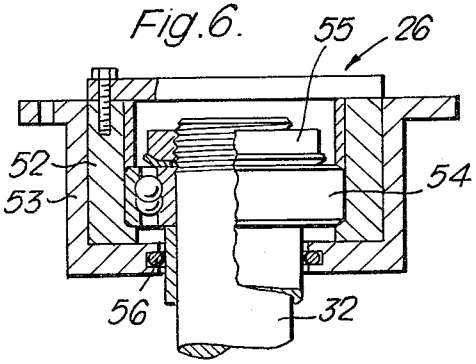
FIG. 6 is a sectional detailed view to a larger scale of the upper bearing assembly, of the pulveriser of FIG. 1.

The cover 11 likewise is of a similar laminated construction in this case in its entirety. It is pierced however by a substantial entrance opening (rimmed by line 23 in FIG. 2) for the infeed of material to be pulverised. The cover 11 has a diametrically extending box beam 24 bolted to it and braced in place by gussets 25 within which is mounted an upper bearing assembly 26 for the pulveriser rotor.

The floor 10 has a similar beam 27 and it is braced with gussets at 28. The beam 27 is used for the support of a lower bearing assembly 29 for the rotor of the pulveriser.

Two access doors 30 and 31 respectively are provided in the outer shell 9 to facilitate maintenance of the pulveriser by giving access, for example, to the nuts on bolts 15.

The rotor of the pulveriser comprises a main shaft 32 extending from the upper bearing assembly 26 to the lower bearing assembly 29, a plurality of hammer support elements designated generally by numeral 33 sleeve mounted upon the sleeve 32*s* upon the shaft 32, a plurality of spacer elements 34 likewise sleeved upon shaft 32 and respectively interposed between the hammer support elements 33 and four tie-bolts 35 securing the hammer support and spacer elements together and, per medium of the lower shoulder 37 and upper flange 37B, securing them to the shaft 32. If desired, in addition to the tiebolts 35 the various spacer elements may be welded after assembly to their contiguous hammer support elements.

Each hammer support element 33 comprises two annular plates 38 (FIGS. 3 and 4) welded to a central sleeve 39.

The two uppermost hammer support elements 33 each support four pivotally mounted bar shaped hammers 40 which are equiangularly spaced around the axis of the pulveriser. The hammer supporting element 33 third from the top of the rotor (FIGS. 1 and 3) supports four disc shaped hammers 41 and the lowermost three hammer support elements 33 (FIGS. 1 and 4) each support four disc shaped hammers 42 of somewhat larger diameter than the hammers 41.

Figure 4:
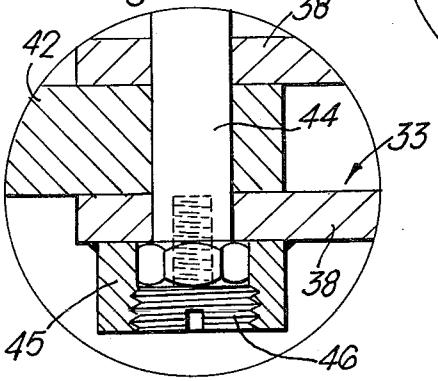
Figure 8:
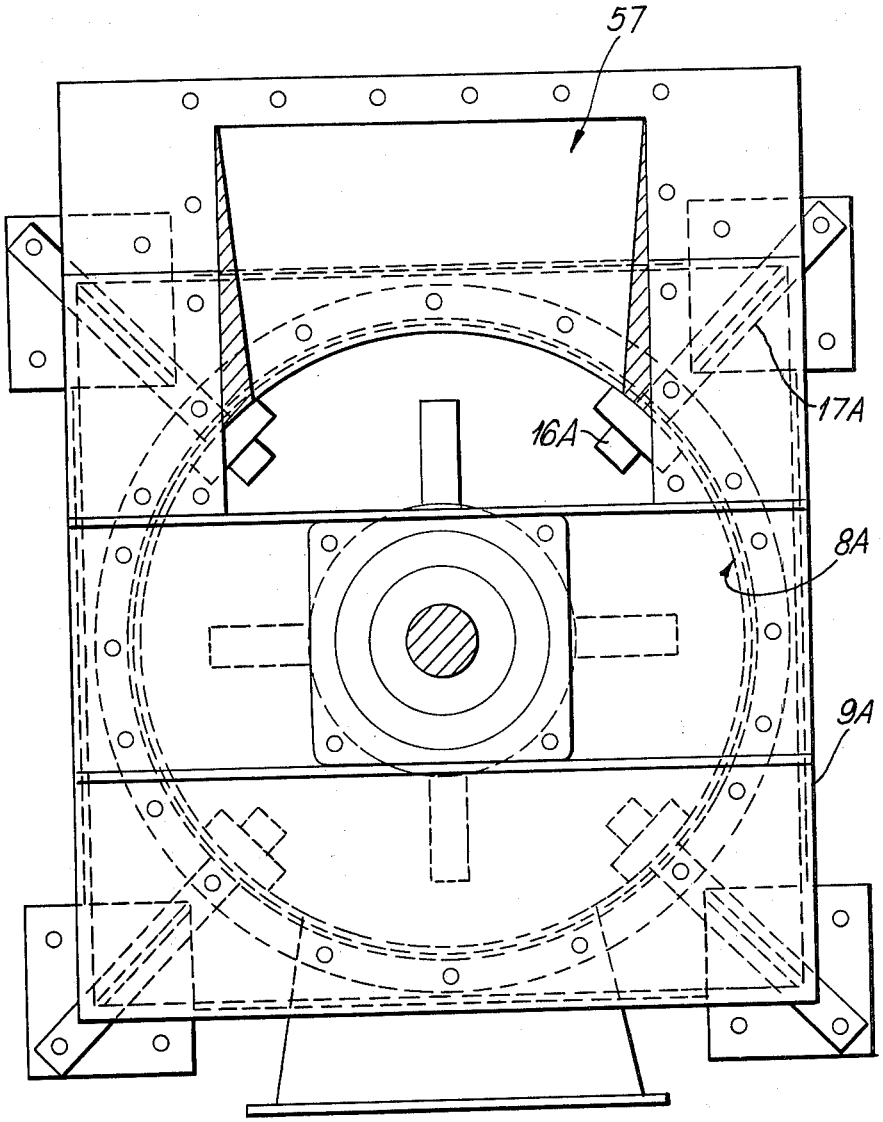
FIG. 8 is a view similar to FIG. 2 of a second embodiment of the invention.

The hammers 40 are supported by upper pivot pins 43 whilst the hammers 41 and 42 are pivoted on lower pivot pins 44 (FIG. 4).

Figure 3:
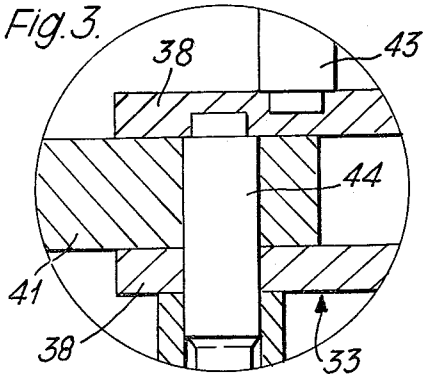
FIG. 3 is a sectional view to a larger scale of the details within the circle 3 of FIG. 1.

As can be seen in FIG. 3 the bottom end of each upper pivot pin 43 and the top end of each lower pivot pin 44 enter blind holes in the top plate 38 of the hammer support elements at which the pins meet to prevent the entry of pulverised material. Similarly, as can be seen from FIG. 4 the bottom end of each lower pivot pin 44 is protected by a housing 45 and a threaded cap 46. A similar arrangement is provided at the top end of each upper pivot pin. Pivot pins 43 and 44 are sleeved between support elements 33 by tubes 36.

Figure 7:
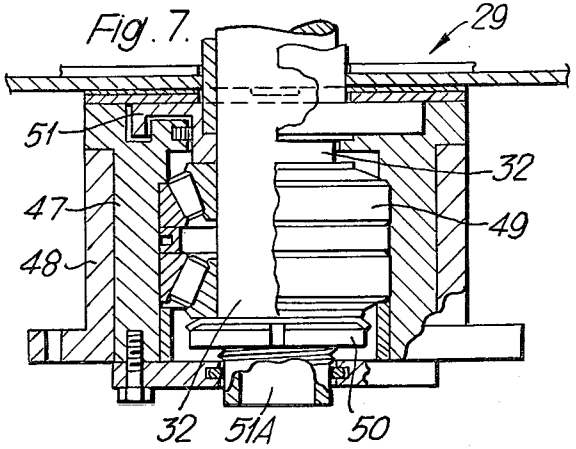
FIG. 7 is a view similar to FIG. 6 of the lower bearing assembly, of the pulveriser of FIG. 1.

The lower bearing assembly 29 (FIGS. 1 and 7) comprises inner and outer casings 47 and 48 respectively, a pair of opposed tapered roller antifriction bearings 49, bearing lock nut 50 a and labyrinth type seal 51. Thus the bearing constrains the shaft 32 against lateral movement as well as supporting the weight of the rotor.

The bottom end of the shaft 32 is internally splined at 51A for connection to a hydraulic or other driving motor (not shown) for the rotor.

The upper bearing assembly 26 comprises inner and outer casings 52 and 53 respectively, a ball antifriction bearing 54, locknut 55 and a less elaborate packing type seal 56. The upper bearing assembly is intended merely to constrain the shaft from lateral displacement and does not contribute towards supporting the weight of the rotor.

In other embodiments of the invention the disc type hammers 41 and 42 may be bar type hammers such as 40, alternatively the bar type hammers 40 may be replaced by disc type hammers.

The second embodiment of the invention is similar in function and general design to the first. The primary differences between the two embodiments are in the shape of the inner and outer shells and the construction of the rotor body. In the case of the second embodiment the inner shell 8A is substantially cylindrical throughout and lacks the upper frustoconical portion of shell 8. The outer shell 9A of the second embodiment is square in cross-section rather than circular. As a result, the space between the shells 8A and 9A is not constant, being a maximum in the vicinity of the corners of shell 9A and a minimum in the vicinity of the centres of its sidewalls. This enables the stationary blades 16A and their supporting tubes 17A to be as long as the corresponding components 16 and 17 of the first embodiment and, therefore, as securely mounted in position while at the same time reducing the floor space required for the pulveriser.

As the inner shell 8A is cylindrical throughout the simple entrance opening for the infeed of material of the first embodiment is replaced by an inlet chute 57 able to deliver material through a side opening formed in the upper part of the otherwise cylindrical inner shell 8A.

The rotor of the second embodiment is simpler and more robust in construction than that of the first. It comprises a solid metal rotor body 59 bolted to upper and lower stub shafts 60 and 61 respectively. The body 59 has a plurality of peripheral grooves 62 formed in it able to accommodate hammers such as 63 (which, in toto, may be identical to the hammers 40 and 42) swing mounted on upper pivot pins 43A and lower pivot pins 44A corresponding to pins 43 and 44 respectively.

Figure 9:
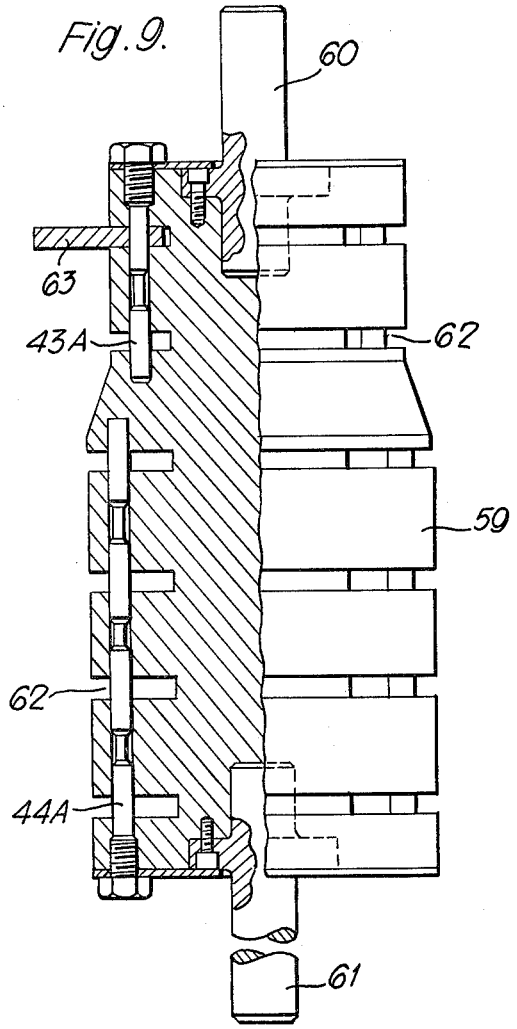
FIG. 9 is a partly sectioned elevation of the rotor body of the pulveriser of FIG. 8.
Figure 10:
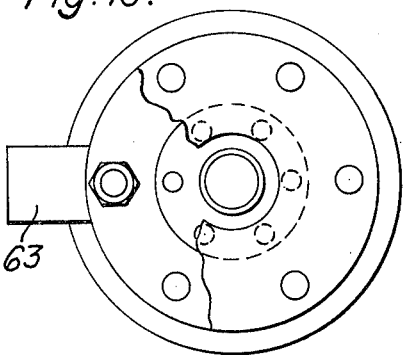
FIG. 10 is a plan view of the rotor body of FIG. 9.

It will be appreciated that the rotor of FIGS. 9 and 10 may be used in a pulveriser otherwise in accordance with FIG. 1 and vice versa.

In its detail construction, the nature of the laminated shells, its rotor support bearings, breaker bars, etc., the second embodiment complies with the first embodiment and, thus, further description of those details is not required.

Figure 11:
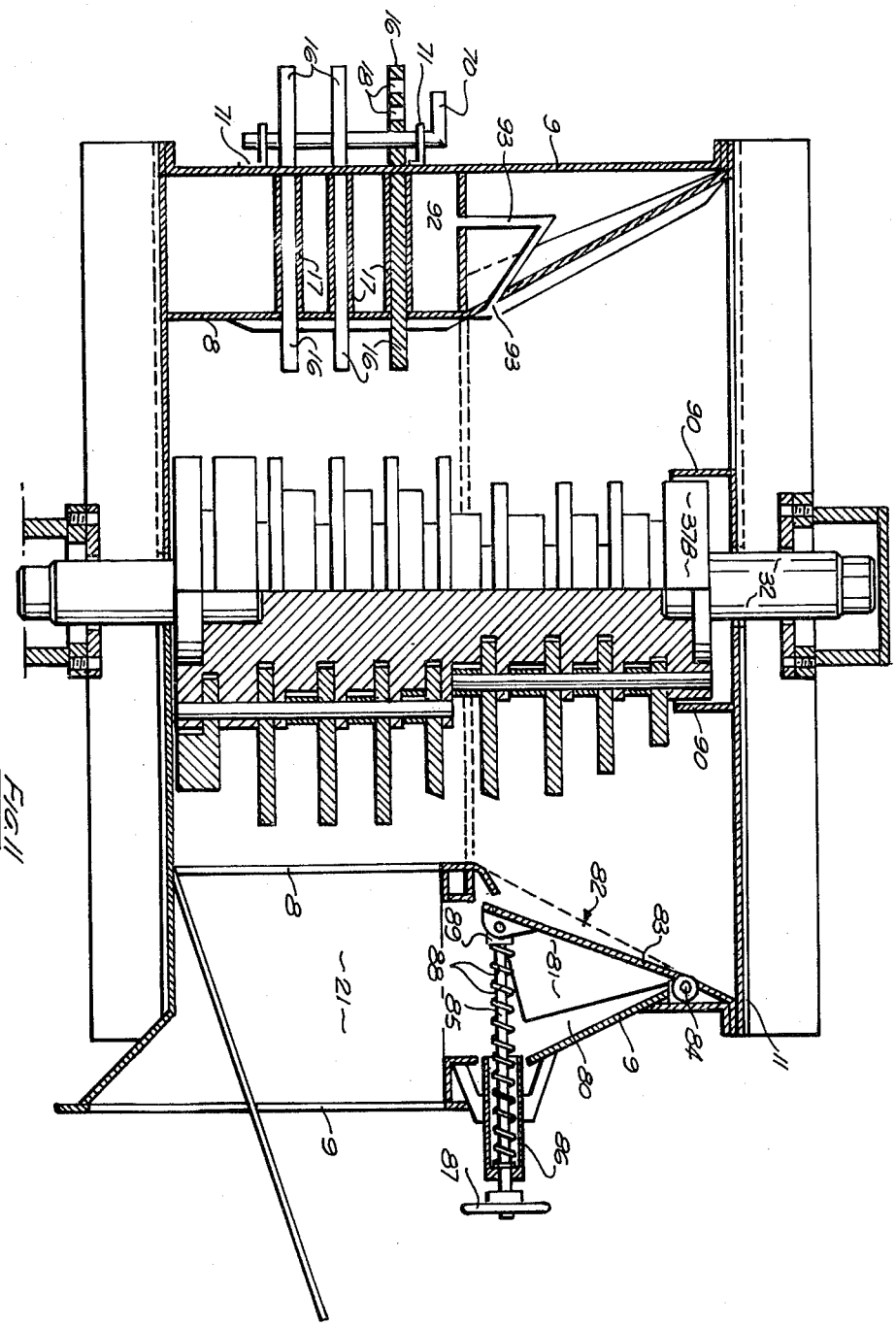
FIG. 11 is a mid-section side elevation of a pulveriser being a third embodiment of the invention illustrating some features additional to those shown in the first embodiment.

A third embodiment shown in FIG. 11 is similar in function and general construction to the first and second embodiments previously described. In this embodiment, each stationary blade 16 in a vertically aligned bank of such blades is held at a setting of longitudinal position by means of a single locking pin 70. The outwardly projecting portion of each stationary blade 16 has, in the illustrated example, three clearance holes 18. For example the setting of maximum retraction of stationary blades 16 may be the optimum setting for pulverising garbage and bottles while the setting of maximum inward extension may be the optimum setting for pulverising aluminium cans and an intermediate setting may be the optimum for pulverising steel cans. At the maximum inward extension used for pulverising garbage, the stationary blades 16 are effective to prevent rags and such like material from winding about the rotating hammer rotor and merely spinning. Locking pin 70 passes through a clearance hole 18 of each stationary blade 16 and also through a clearance hole in an upper and a lower bracket 71 mounted on outer shell 9. Locking pin 70 is provided with a handle which prevents it from falling out. On withdrawing locking pin 70, any of the stationary blades 16 of the bank may be adjusted longitudinally to a new setting.

Preferably, as also shown in FIG. 11, a collar 90 is mounted on cover 11 concentric with the main shaft 32 and extending downwardly to guard upper flange 37B so that rags and such like material are prevented from winding around the main shaft and becomming jammed between the upper surface of flange 37B and the interior surface of cover 11.

Space 92 between the inner shell 8 and outer shell 9 may be pressurized with air and ducts 93 leading therefrom may be employed to direct the air under pressure downwardly towards the main work space between stationary blade 16 and hammers attached to shaft 32 thus urging lighter material into the main work space.

Figure 12:
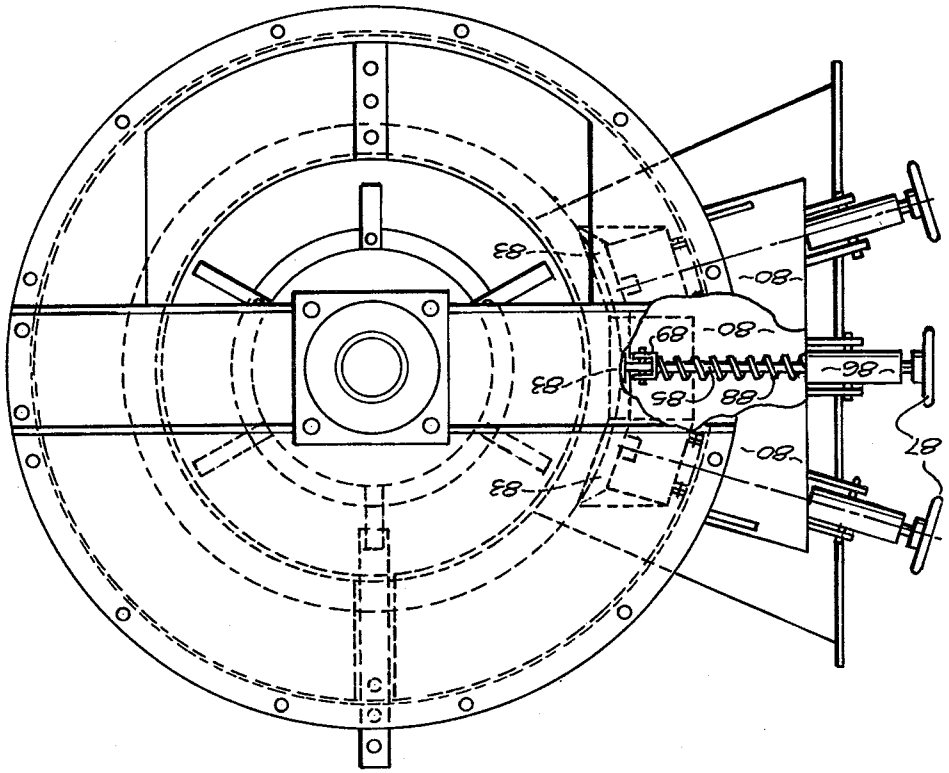
FIG. 12 is a plan view of the pulveriser shown in FIG. 11 with its top partly cut away to reveal internal details.

With reference to FIGS. 11 and 12, a preferred embodiment has a chamber 80 located between inner shell 8 and outer shell 9, and communicating through a large opening with trunk 21 of the bottom outlet.

The chamber 80 also communicates with the interior of the pulveriser through an opening indicated generally at 82 in the outwardly diverging upper portion of inner shell 8.

When the pulveriser is not in operation opening 82 is closed by three flaps 83. Each flap is swing mounted by hinges 84 at its upper edge. Flaps 83 are adjacent each other and, when in a closed position, shut off chamber 80 from the pulveriser interior.

In the present example, each flap 83 may be manually opened or closed by means of shaft 85 one end of which is pivotally connected at or near the lower edge of the flap 83 and the opposite end of which projects through an aperture in spring retaining socket 86 mounted on outer shell 9 and is fitted with a handle 87 exterior to the pulveriser.

Each flap is held in a normally closed position by bias means—in this case a compression spring 88 retained on shaft 85 and bearing at one end against retaining socket 86 and at its opposite end against collar 89 mounted on shaft 84.

When the pulveriser is in operation, heavy articles which are likely to cause damage to the pulveriser or to become jammed may be flung against a flap 83 pushing it open, thereby by-passing the pulveriser and falling through chamber 80 into trunk 21 of the bottom outlet. Side wings 81 on each flap 83 ensure that material striking a flap and causing it to open falls into trunk 21. Independent opening of flaps 83 allow heavy articles of various size to by-pass the pulveriser without admitting more than necessary to chamber 80.

It will be understood that other means of closure of opening 82, and of biasing the closure against opening, could be used and that the by-pass arrangement need not feed the bottom outlet but could feed a separate outlet.

According to a fourth embodiment illustrated with reference to FIG. 13, the setting of longitudinal position of stationary blades 16, that is to say the extent to which the blades project inwardly of inner shell 8, is adjusted by ram means indicated generally at 72. Stationary blades 16 are connected together at or near their outwardly projecting ends by a rigid member 73 which in turn is pivotally connected to a ram 74 actuated by hydraulic pressure in cylinder 75. Hydraulic pressure maybe applied to cylinder 75 by means of pressure lines 76 connected at or near each end so that the stationary blades 16 can thereby be fully extended, or fully retracted, or held at an intermediate longitudinal setting. In the present example, the setting is determined by a valve 77 on hydraulic pressure lines 76 to cylinder 75 and may be set manually.

Figure 13:
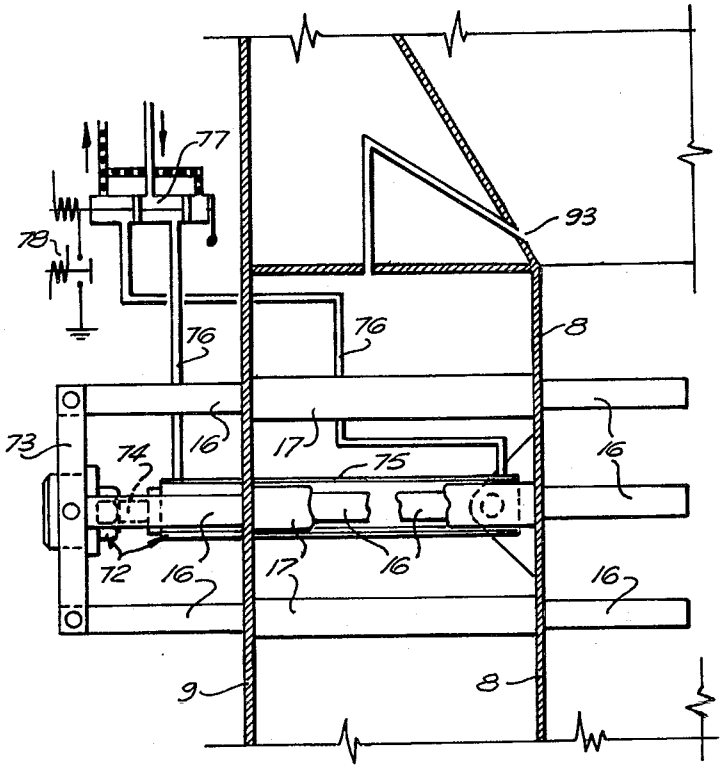
FIG. 13 is a schematic diagram of a fourth embodiment in which the longitudinal setting of stationary blades is achieved by hydraulic means.

In addition to manual operation, valve 77 may be operated by a solenoid which in turn may be energised by a relay 78 operated by a micro-switch (not shown in FIG. 13) mounted adjacent a swing flap 83 (also not shown in FIG. 13). The micro-switch is set to actuate relay 78 upon a flap 83 opening to a pre-determined opening angle, in the present example, of 50. By these means, a large object causing flap 83 to open to the pre-determined angle causes stationary blades 16 to fully retract minimising risk of damage or jamming of the pulveriser.

Figure 14:
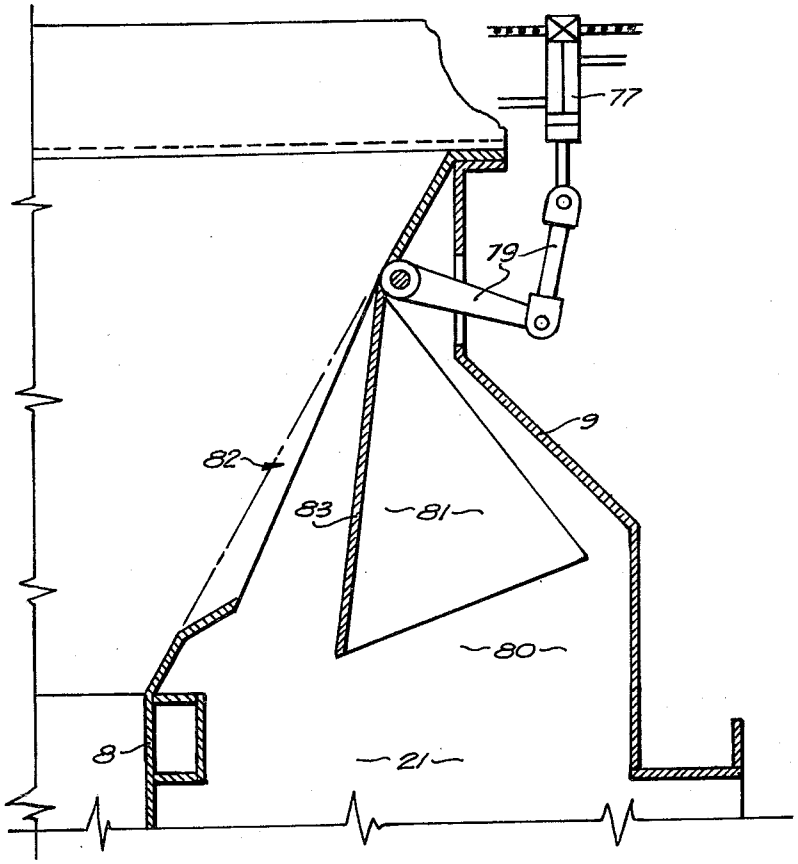
FIG. 14 is a schematic diagram of a fifth embodiment in which the hydraulic means of FIG. 13 are actuated upon opening of flaps shown in FIGS. 11 and 12.

According to a fifth embodiment shown schematically in FIG. 14, the manual setting of valve 77 (which controls the longitudinal setting of stationary blades 16 via ram means 72 shown in FIG. 13) may be overridden by a system of mechanical linkages indicated generally at 79 upon opening of a flap 83.

I claim:

1. A pulveriser of the kind comprising a barrel having an open top for infeed of material to be pulverised and a bottom outlet for departure of pulverised material, an upright rotor rotatable within the barrel and a plurality of hammers mounted on the rotor; characterised in that a plurality of stationary blades are cantilevered to project inwardly from the barrel wall so as to be out of contact with the hammers, said barrel comprises an inner shell spaced radially from an outer shell and enclosed by the latter, a plurality of bracing tubes extend radially from one shell to the other and supported by both, and said stationary blades are at least partially housed by said bracing tubes whereby said stationary blades are braced against lateral forces.

2. A pulveriser according to claim 1 wherein the extent to which at least some of said stationary blades project from said bracing tubes inwardly into said barrel is adjustable.

3. A pulveriser according to claim 1 or claim 2, wherein said hammers are pivotally mounted on said rotor.

4. A pulveriser according to claim 1 or claim 2, wherein the extent to which the hammers project from the rotor varies from hammer to hammer with at least one upper hammer projecting to a lesser extent than at least one lower hammer.

5. A pulveriser according to claim 1 or claim 2, wherein at least some of said hammers are in the form of discs.

6. A pulveriser according to claim 1 or claim 2, provided in addition with an outlet fitted with a hinged flap closure, said flap being normally closed by bias means, whereby objects likely to jam the pulveriser may bypass the main working space of the pulveriser.

7. A pulveriser according to claim 6 having sensor means for detecting the opening of said hinged flap to a pre-determined opening angle and control ram means connected to said sensor means to cause said stationary blades to be retracted from said barrel by a pre-determined amount.

8. A pulveriser according to claim 1 wherein at least some of said stationary blades project adjustably inwardly from the barrel wall and wherein locking piece means is provided to hold said blades in one or another of a plurality of their adjusted positions.

9. A pulveriser according to claim 1 wherein some of said blades are mounted for inward adjustment, and pressure actuated ram means is provided for effecting such adjustment.

* * * * *